US010020138B1

(12) United States Patent
Pan et al.

(10) Patent No.: US 10,020,138 B1
(45) Date of Patent: Jul. 10, 2018

(54) KEYBOARD DEVICE

(71) Applicant: Primax Electronics Ltd., Taipei (TW)

(72) Inventors: Chin-Sung Pan, Taipei (TW); Ming-Han Wu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/627,104

(22) Filed: Jun. 19, 2017

(30) Foreign Application Priority Data

Feb. 24, 2017 (TW) ..... 106106452 A

(51) Int. Cl.
*H01H 3/12* (2006.01)
*H01H 13/70* (2006.01)

(52) U.S. Cl.
CPC ..... *H01H 13/70* (2013.01); *H01H 3/125* (2013.01); *H01H 2221/058* (2013.01); *H01H 2221/062* (2013.01); *H01H 2233/07* (2013.01)

(58) Field of Classification Search
CPC ..... H01H 3/125; H01H 2009/0278; H01H 2233/07; H01H 2221/058; H01H 2221/062
USPC ..... 200/344
See application file for complete search history.

(56) References Cited

U.S. PATENT DOCUMENTS

| | | | | |
|---|---|---|---|---|
| 5,823,325 | A * | 10/1998 | Lin | H01H 3/125 200/344 |
| 6,057,522 | A * | 5/2000 | Chao | H01H 3/122 200/341 |
| 7,312,414 | B2 * | 12/2007 | Yatsu | H01H 3/125 200/344 |
| 9,837,220 | B2 * | 12/2017 | Hou | H01H 3/122 |
| 9,837,221 | B2 * | 12/2017 | Liao | H01H 3/125 |
| 2017/0062151 | A1 * | 3/2017 | Iso | H01H 13/14 |

* cited by examiner

*Primary Examiner* — Felix O Figueroa
(74) *Attorney, Agent, or Firm* — Kirton McConkie; Evan R. Witt

(57) ABSTRACT

A keyboard device includes a key structure, a switch circuit board, a base plate and a buffering sheath. The key structure includes a keycap and a stabilizer bar. The stabilizer bar is connected with the keycap. The base plate includes a connecting structure. The stabilizer bar is penetrated through the connecting structure and connected with the base plate. The buffering sheath is arranged around the stabilizer bar to cover the stabilizer bar. The stabilizer bar and the base plate are made of metallic material. Since the stabilizer bar and the base plate are separated by the buffering sheath, the keyboard device is capable of reducing noise.

10 Claims, 9 Drawing Sheets

KEYBOARD DEVICE

FIELD OF THE INVENTION

The present invention relates to an input device, and more particularly to a keyboard device with plural key structures.

BACKGROUND OF THE INVENTION

Generally, the widely-used peripheral input device of a computer system includes for example a mouse device, a keyboard device, a trackball device, or the like. Via the keyboard device, characters or symbols can be inputted into the computer system directly. As a consequence, most users and most manufacturers of input devices pay much attention to the development of keyboard devices. The subject of the present invention is related to a keyboard device.

FIG. 1 is a schematic top view illustrating the outer appearance of a conventional keyboard device. As shown in FIG. 1, plural key structures 10 and 10' are disposed on a top surface of the conventional keyboard device 1. The key structures 10 have the ordinary sizes. The key structures 10' are relatively longer. That is, the length of the key structure 10 is slightly larger than the width of the key structure 10, and the length L1 of the key structure 10' is much larger than the width W1 of the key structure 10'. When one of the key structures 10 and 10' is depressed by the user's finger, a corresponding key signal is generated to the computer, and thus the computer executes a function corresponding to the depressed key structure. Generally, the user may depress the key structures 10 and 10' to input corresponding English letters (or symbols) or numbers or execute various functions (e.g., F1~F12 or Delete). For example, the conventional keyboard device 1 is a keyboard for a notebook computer.

The structures of the conventional keyboard device will be illustrated as follows. FIG. 2 is a schematic exploded view illustrating a portion of the conventional keyboard device and taken along a viewpoint. FIG. 3 is a schematic exploded view illustrating a portion of the conventional keyboard device and taken along another viewpoint. Please refer to FIGS. 1, 2 and 3. The conventional keyboard device 1 comprises plural key structures 10 and 10', a metallic base plate 11 and a membrane circuit board 12. The membrane circuit board 12 comprises plural membrane switches 121 corresponding to the plural key structures 10 and 10'. Each of the plural key structures 10 and 10' comprises a keycap 101, at least one scissors-type connecting element 102 and a rubbery elastomer 103. The scissors-type connecting element 102 is connected between the keycap 101 and the metallic base plate 11. Moreover, the scissors-type connecting element 102 comprises a first frame 1021 and a second frame 1022. The second frame 1022 is pivotally coupled to the first frame 1021. Consequently, the first frame 1021 and the second frame 1022 can be swung relative to each other. The rubbery elastomer 103 is arranged between the keycap 101 and the metallic base plate 11. Moreover, the rubbery elastomer 103 comprises a contacting part 1031.

While the keycap 101 of any key structure 10 or 10' is depressed and moved downwardly relative to the metallic base plate 11, the first frame 1021 and the second frame 1022 of the scissors-type connecting element 102 are switched from an open-scissors state to a stacked state. Moreover, as the keycap 101 is moved downwardly to compress the rubbery elastomer 103, the corresponding membrane switch 121 is pushed and triggered by the contacting part 1031 of the rubbery elastomer 103. Consequently, the membrane circuit board 12 generates a corresponding key signal. When the keycap 101 of the key structure 10 or 10' is no longer depressed, the keycap 101 is moved upwardly relative to the metallic base plate 11 in response to an elastic force of the rubbery elastomer 103. Meanwhile, the first frame 1021 and the second frame 1022 are switched from the stacked state to the open-scissors state again, and the keycap 101 is returned to its original position.

In the keyboard device 1, the key structures 10' and the key structures 10 are distinguished. As shown in the drawings, the length L1 of the key structure 10' is much larger than the width W1 of the key structure 10'. Since the length L1 of the keycap 101 of the key structure 10' is relatively longer, the keycap 101 is readily rocked while the key structure 10' is depressed. That is, the operating smoothness of the key structure 10' is adversely affected, and even the tactile feel of the user is impaired. For increasing the operating smoothness of the key structure 10', the key structure 10' is further equipped with a special mechanism. For example, the key structure 10' further comprises a first stabilizer bar 104 and a second stabilizer bar 105. The first stabilizer bar 104 comprises a first linking bar part 1041 and two first hook parts 1042. The two first hook parts 1042 are located at two ends of the first stabilizer bar 104, respectively. The second stabilizer bar 105 comprises a second linking bar part 1051 and two second hook parts 1052. The two second hook parts 1052 are located at two ends of the second stabilizer bar 105, respectively.

The metallic base plate 11 comprises a first connecting structure 111 and a second connecting structure 112. The first connecting structure 111 and the second connecting structure 112 are protruded upwardly, and penetrated through the membrane circuit board 12. The first connecting structure 111 comprises a first locking hole 1111 and a third locking hole 1112. The second connecting structure 112 comprises a second locking hole 1121 and a fourth locking hole 1122. The second locking hole 1121 corresponds to the first locking hole 1111, and the fourth locking hole 1122 corresponds to the third locking hole 1112.

The first linking bar part 1041 of the first stabilizer bar 104 and the second linking bar part 1051 of the second stabilizer bar 105 are pivotally coupled to the keycap 101 of the key structure 10'. The two first hook parts 1042 of the first stabilizer bar 104 are penetrated through the first locking hole 1111 of the first connecting structure 111 and the second locking hole 1121 of the second connecting structure 112, respectively. The two second hook parts 1052 of the second stabilizer bar 105 are penetrated through the third locking hole 1112 of the first connecting structure 111 and the fourth locking hole 1122 of the second connecting structure 112, respectively.

FIG. 4 is a schematic perspective view illustrating a portion of the combination of the metallic base plate and the membrane circuit board of the conventional keyboard device. FIG. 5 schematically illustrates the actions of the first stabilizer bar and the second stabilizer bar of the conventional keyboard device. Please refer to FIGS. 4 and 5. While the keycap 101 of the key structure 10' is moved upwardly or downwardly relative to the metallic base plate 11, the first stabilizer bar 104 is moved in a first direction D11 or a second direction D12 and rotated in a first rotating direction D13 or a second rotating direction D14. Similarly, the second stabilizer bar 105 is moved in the first direction D11 or the second direction D12 and rotated in the first rotating direction D13 or the second rotating direction D14. By the first stabilizer bar 104 and the second stabilizer bar 105, the key structure 10' is kept stable and not inclined while the key structure 10' is moved upwardly or downwardly relative to the metallic base plate 11. Moreover, the uses of the first stabilizer bar 104 and the second stabilizer bar 105 are helpful to increase the strength of the keycap 101.

However, the conventional keyboard device 1 still has some drawbacks. For example, all of the first stabilizer bar 104, the second stabilizer bar 105 and the metallic base plate 11 are made of metallic material. Please refer to FIGS. 4 and 5. While the keycap 101 of the key structure 10' is moved upwardly or downwardly relative to the metallic base plate 11 and the first stabilizer bar 104 and the second stabilizer bar 105 are correspondingly moved and rotated, the two first hook parts 1042 of the first stabilizer bar 104 and the two second hook parts 1052 of the second stabilizer bar 105 are readily contacted with the metallic base plate 11. While the two first hook parts 1042 and the two second hook parts 1052 collide with the metallic base plate 11, a click sound is generated. Especially when the R corners of the two first hook parts 1042 and the two second hook parts 1052 (e.g., the regions indicated by oblique lines of FIG. 5) collide with the metallic base plate 11, the click sound is generated. This sound is unpleasant noise to the user.

Therefore, there is a need of providing a keyboard device with reduced noise.

SUMMARY OF THE INVENTION

An object of the present invention provides a keyboard device with reduced noise.

In accordance with an aspect of the present invention, there is provided a keyboard device. The keyboard device includes a key structure, a switch circuit board, a base plate and a buffering sheath. The key structure includes a keycap and a stabilizer bar. The keycap is exposed outside the keyboard device. The stabilizer bar is connected with the keycap. The switch circuit board is located under the key structure, and includes a key switch corresponding to the key structure. When the key switch of the switch circuit board is triggered by the key structure, a key signal is generated. The base plate is located under the switch circuit board, and supports the key structure. The base plate includes a connecting structure. The connecting structure is connected with the stabilizer bar. The buffering sheath covers the stabilizer bar. The buffering sheath and the stabilizer bar are collaboratively connected with the connecting structure. The stabilizer bar and the connecting structure are separated from each other through the buffering sheath.

From the above descriptions, the present invention provides the keyboard device. The buffering sheath is arranged around the stabilizer bar. Consequently, the stabilizer bar is covered by the buffering sheath and not exposed to the outside. The hook part is separated from the connecting structure of the base plate by the buffering sheath. The buffering sheath is made of the soft material. The stabilizer bar made of the metallic material is partially covered by the buffering sheath. Even if the hook parts are made of the metallic material, the hook parts are only contacted with the buffering sheath but not contacted with the metallic connecting structure. That is, the metallic components do not collide with each other to generate the unpleasant noise. Consequently, the keyboard device of the present invention is capable of reducing the noise.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For overcoming the drawbacks of the conventional technologies, the present invention provides a keyboard device. First of all, the structure of the keyboard device will be illustrated as follows.

Figure 1:
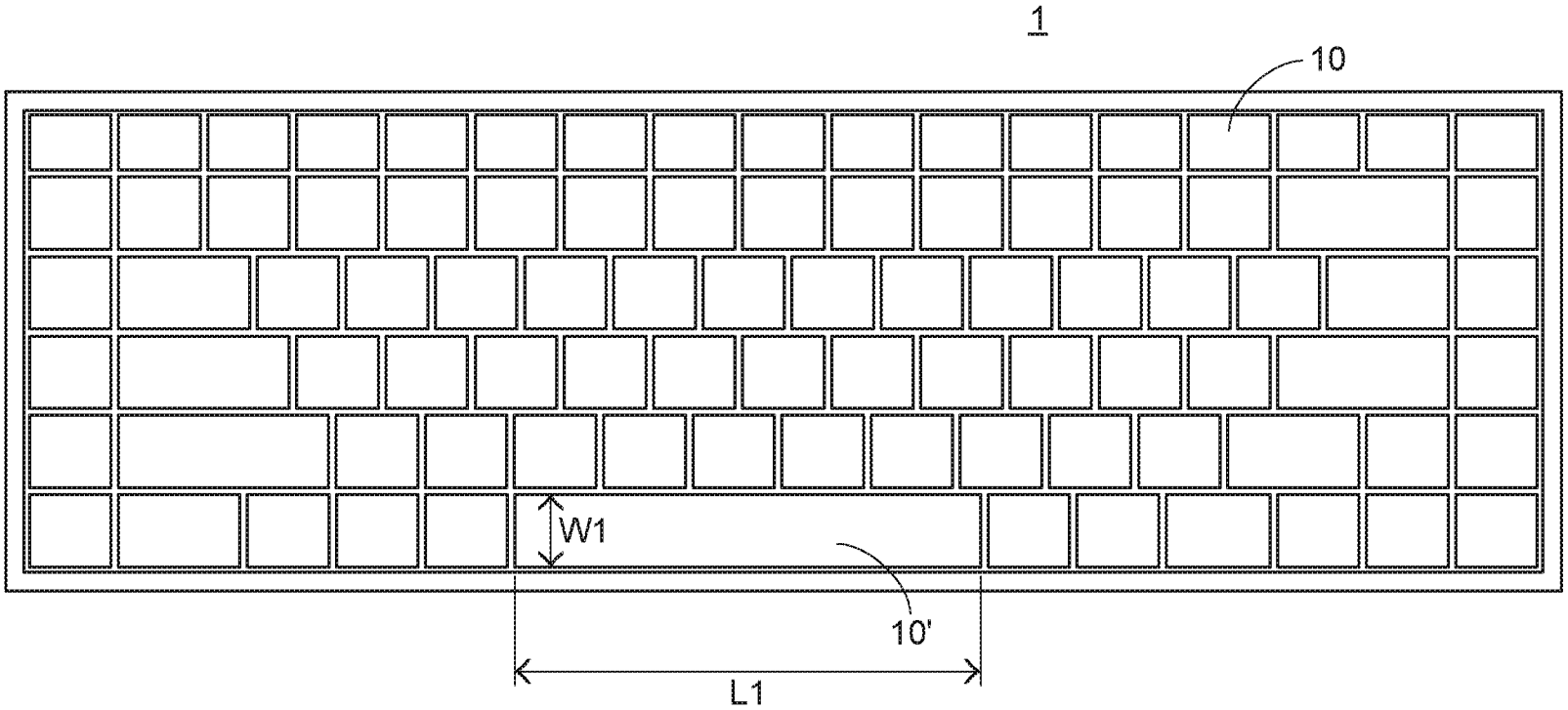
FIG. 1 PRIOR ART
FIG. 1 is a schematic top view illustrating the outer appearance of a conventional keyboard device.
Figure 2:
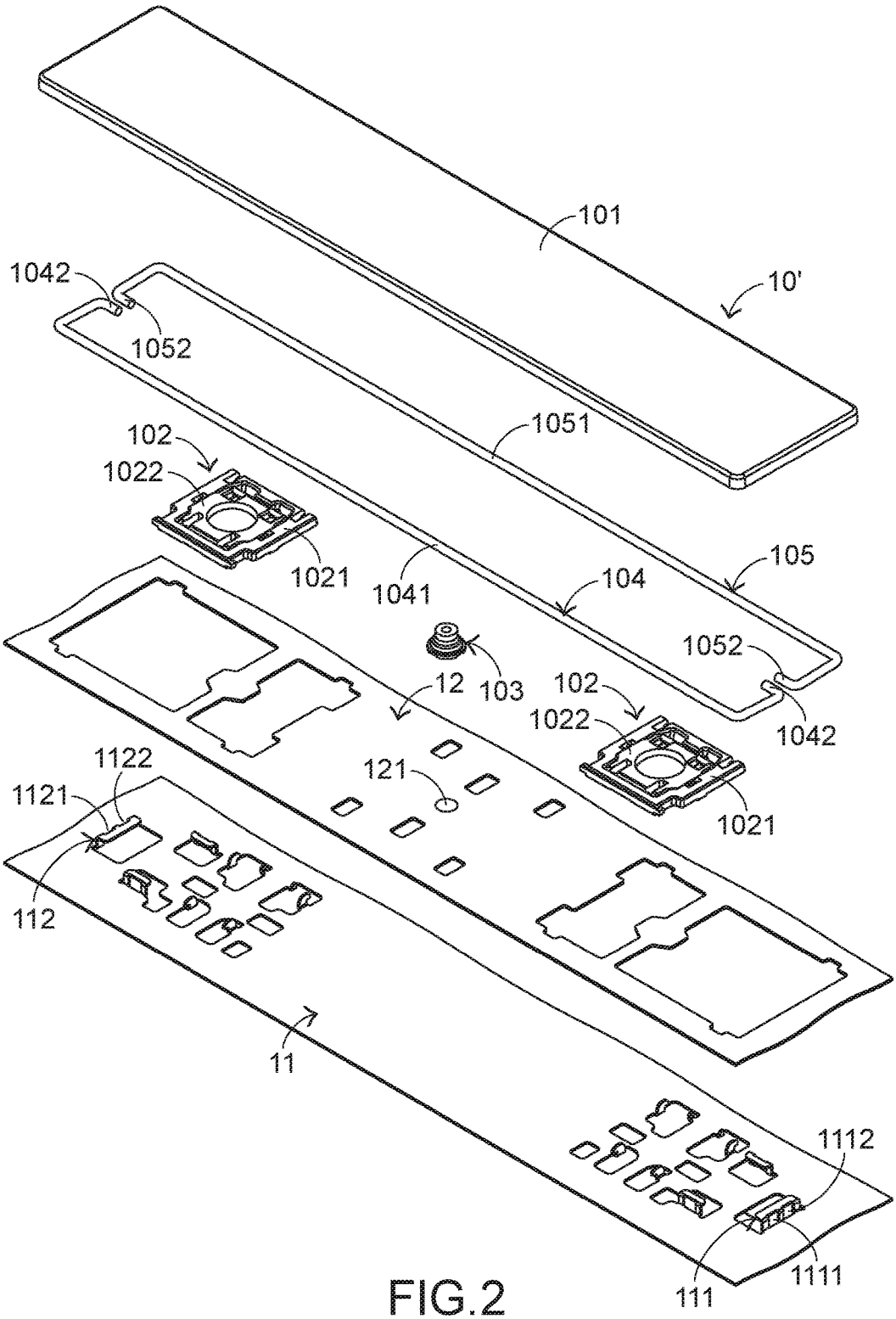
FIG.2 PRIOR ART
FIG. 2 is a schematic exploded view illustrating a portion of the conventional keyboard device and taken along a viewpoint.
Figure 3:
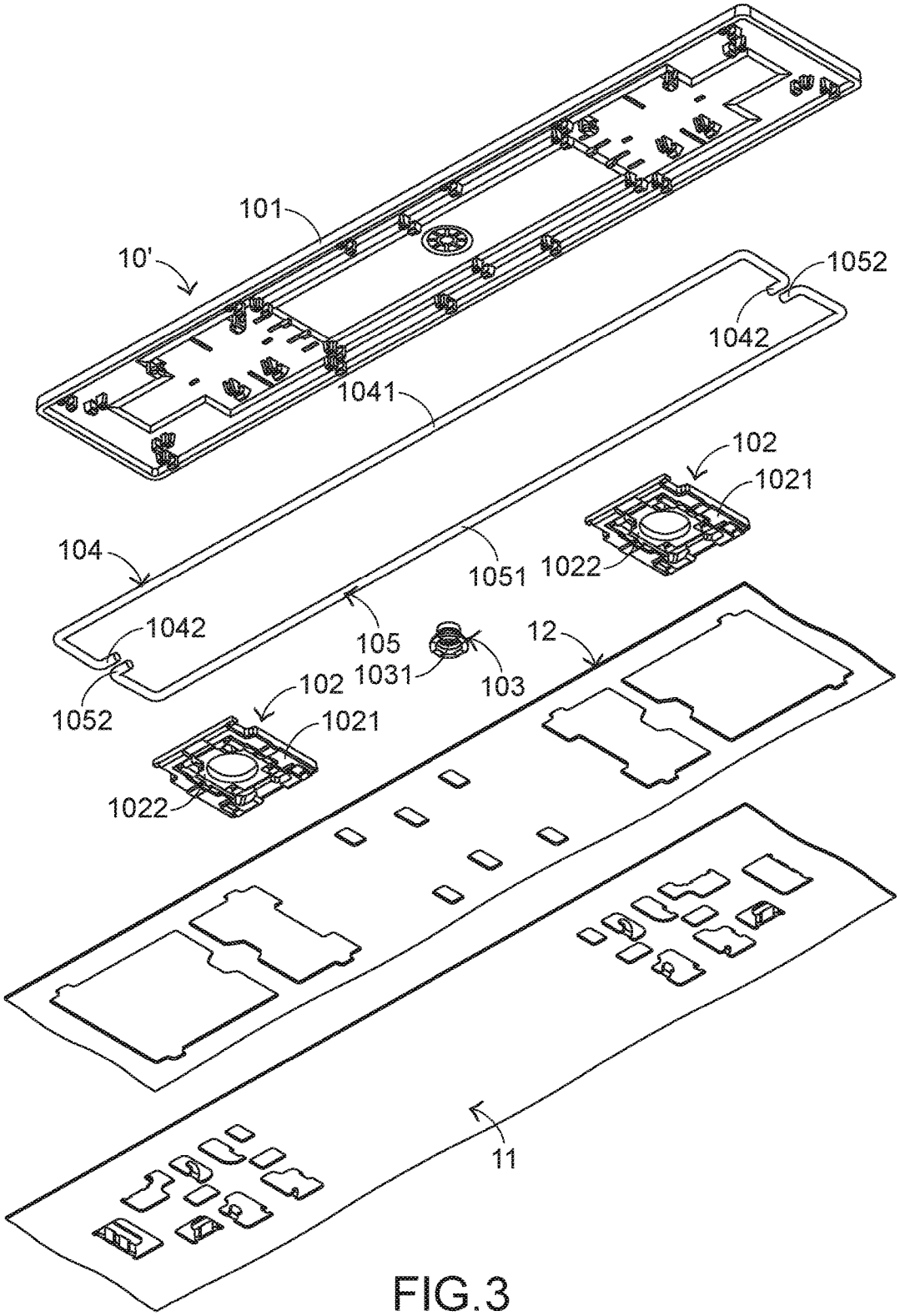
FIG.3 PRIOR ART
FIG. 3 is a schematic exploded view illustrating a portion of the conventional keyboard device and taken along another viewpoint.
Figure 4:
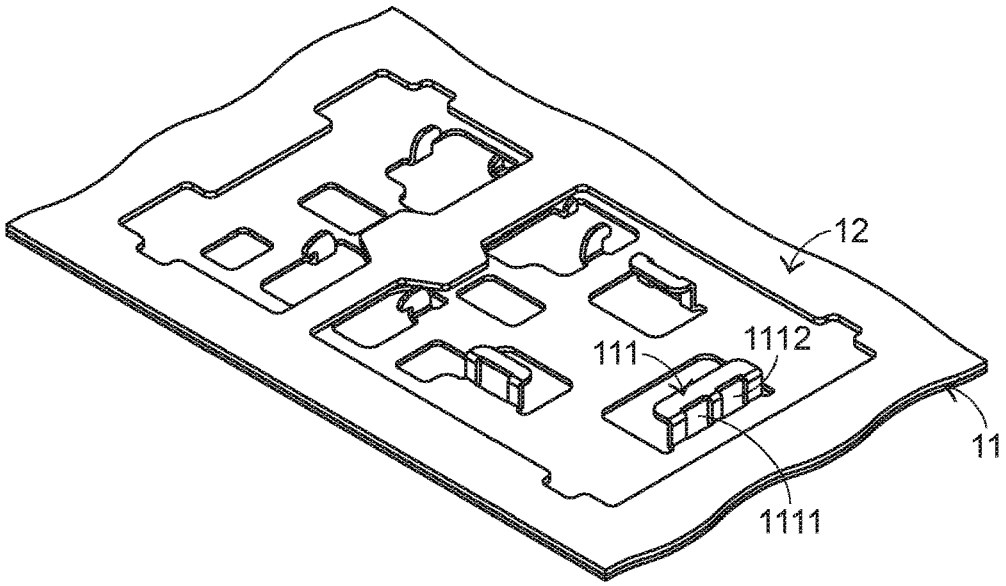
FIG.4 PRIOR ART
FIG. 4 is a schematic perspective view illustrating a portion of the combination of the metallic base plate and the membrane circuit board of the conventional keyboard device.
Figure 5:
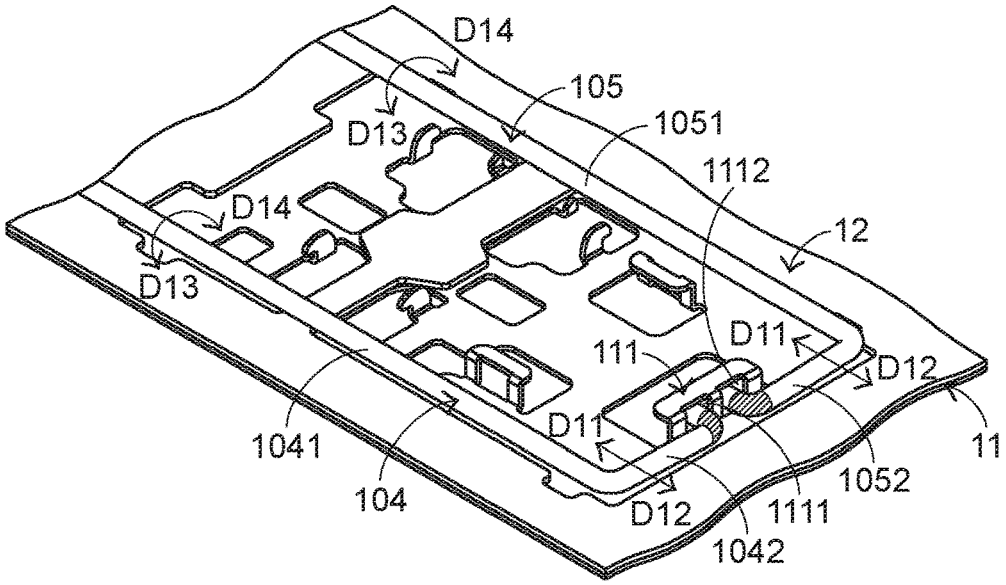
FIG.5 PRIOR ART
FIG. 5 schematically illustrates the actions of the first stabilizer bar and the second stabilizer bar of the conventional keyboard device.
Figure 6:
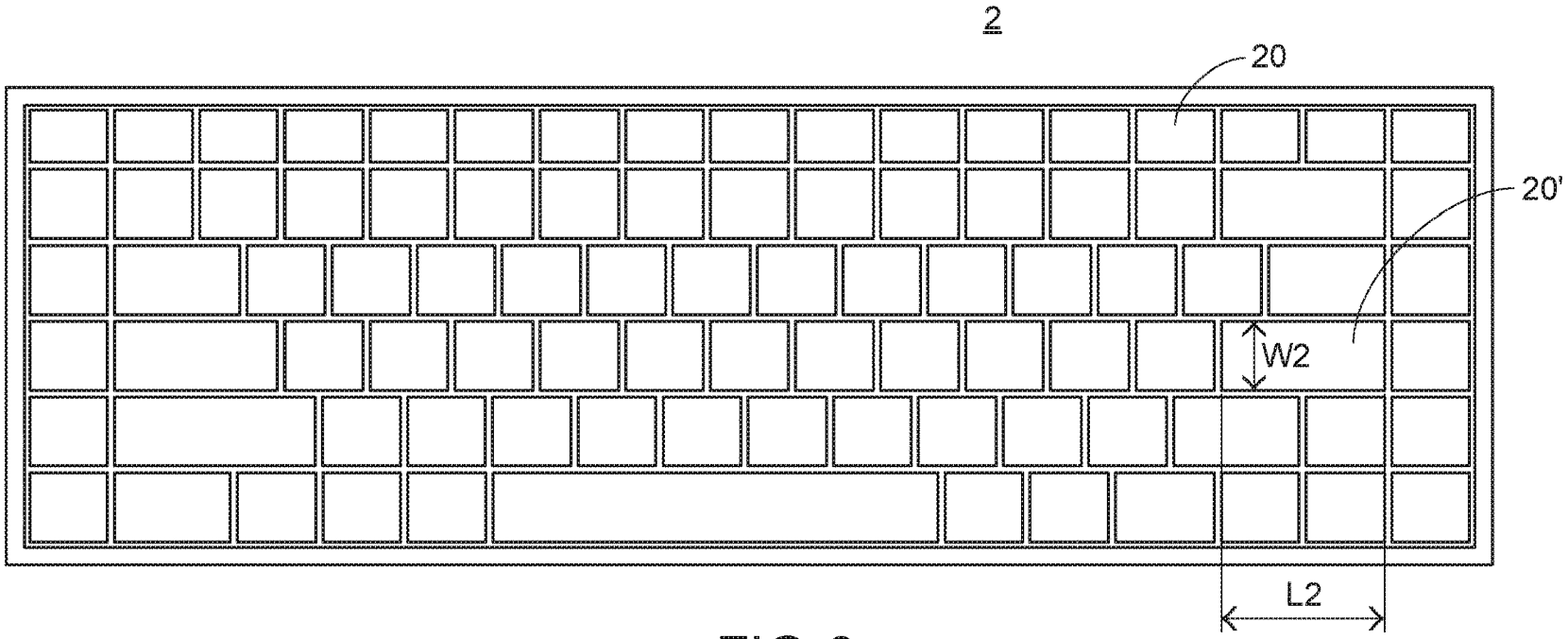
FIG. 6 is a schematic top view illustrating the outer appearance of a keyboard device according to an embodiment of the present invention.

FIG. 6 is a schematic top view illustrating the outer appearance of a keyboard device according to an embodiment of the present invention. The keyboard device 2 comprises plural key structures 20 and 20'. These key structures 20 and 20' are exposed outside the keyboard device 2. When one of the key structures 20 and 20' is depressed by the user's finger, a corresponding key signal is generated to a computer (not shown) that is in communication with the keyboard device 2. Consequently, the computer executes a function corresponding to the depressed key structure. The length of the key structure 20 is slightly larger than the width of the key structure 20. The length L2 of the key structure 20' is much larger than the width W2 of the key structure 20'.

Figure 7:
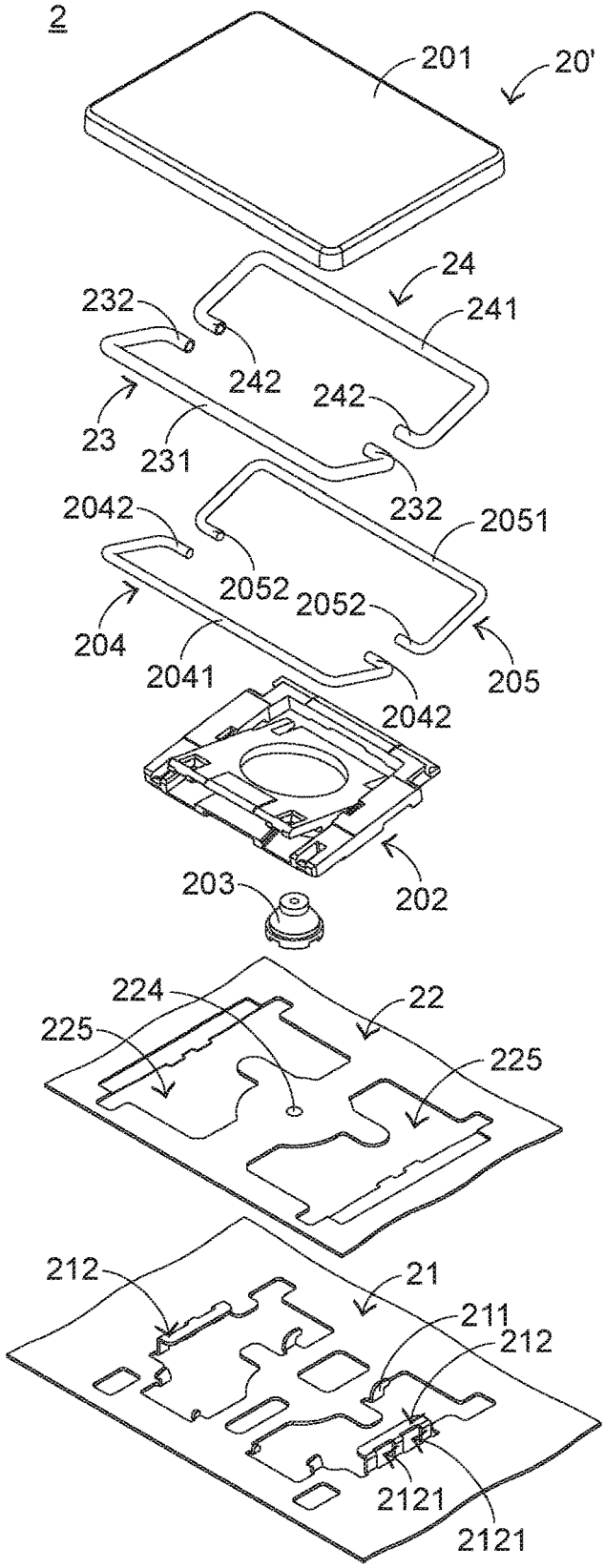
FIG. 7 is a schematic exploded view illustrating a portion of the keyboard device according to the embodiment of the present invention and taken along a viewpoint.
Figure 8:
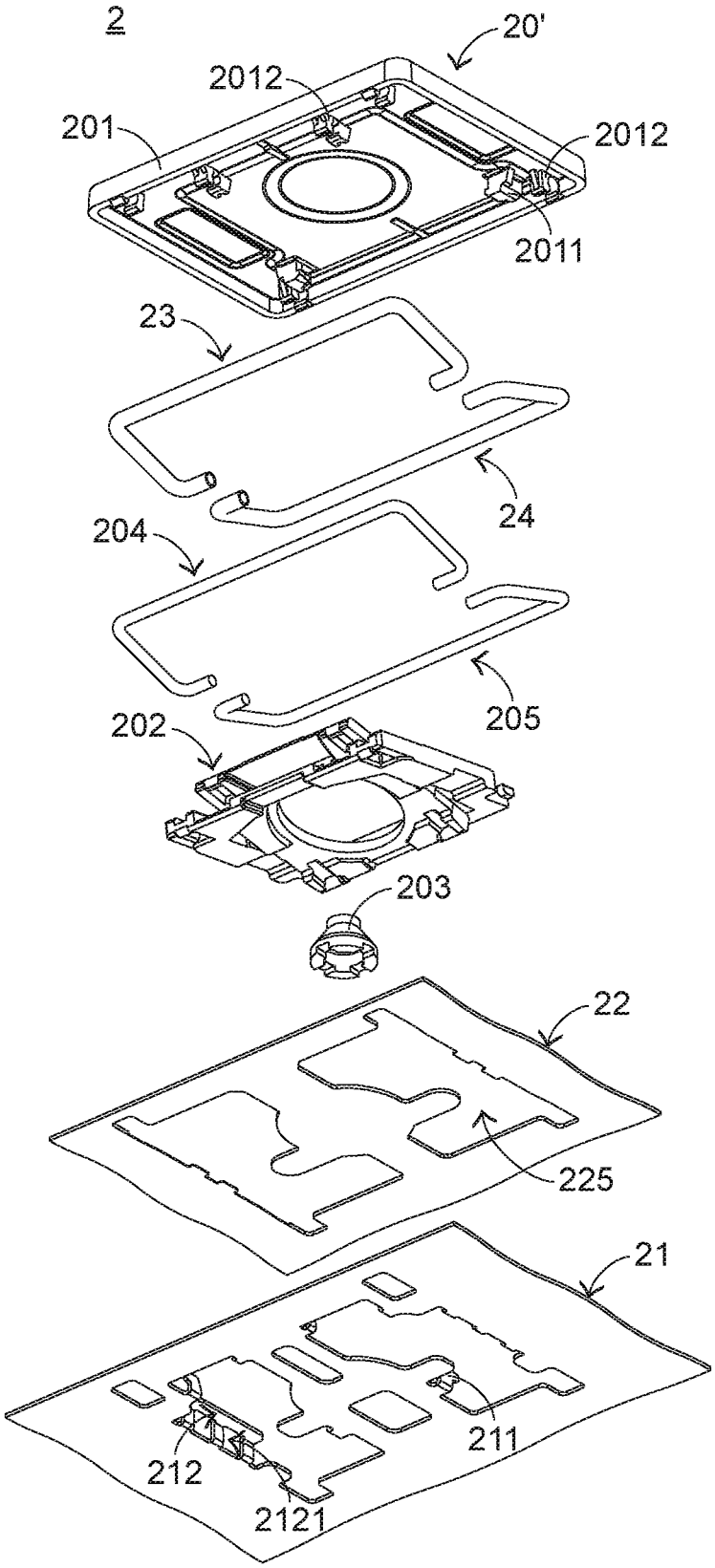
FIG. 8 is a schematic exploded view illustrating a portion of the switch circuit board of the keyboard device according to the embodiment of the present invention.
Figure 9:
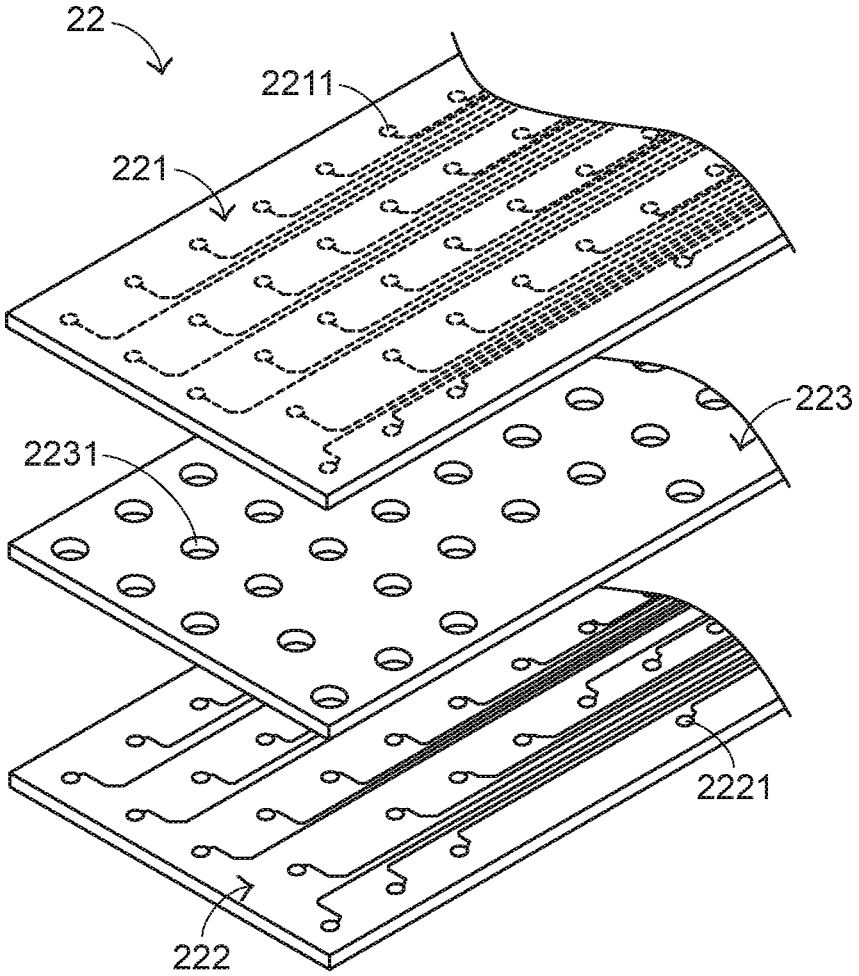
FIG. 9 is a schematic exploded view illustrating a portion of the switch circuit board of the keyboard device according to the embodiment of the present invention.

Hereinafter, the inner structure of the keyboard device 2 will be illustrated with reference to FIGS. 7, 8 and 9. FIG. 7 is a schematic exploded view illustrating a portion of the keyboard device according to the embodiment of the present invention and taken along a viewpoint. FIG. 8 is a schematic exploded view illustrating a portion of the keyboard device according to the embodiment of the present invention and taken along another viewpoint. FIG. 9 is a schematic exploded view illustrating a portion of the switch circuit board of the keyboard device according to the embodiment of the present invention. In addition to the plural key structures 20 and 20', the keyboard device 2 further comprises a base plate 21, a switch circuit board 22, a first buffering sheath 23 and a second buffering sheath 24. The base plate 21 is located under the plural key structures 20 and 20' and connected with the plural key structures 20 and 20'. The switch circuit board 22 is arranged between the plural key structures 20, 20' and the base plate 21. When the switch circuit board 22 is triggered by one of the plural key structures 20 and 20', a corresponding key signal is generated. The switch circuit board 22 comprises an upper wiring plate 221, a lower wiring plate 222, a separation layer 223, a key switch 224 and plural openings 225.

Each of the key structures 20' comprises a keycap 201, at least one scissors-type connecting element 202, an elastic element 203, a first stabilizer bar 204 and a second stabilizer bar 205. The scissors-type connecting element 202 is connected with the corresponding keycap 201 and the base plate 21. Through the scissors-type connecting element 202, the keycap 201 is fixed on the base plate 21 and movable relative to the base plate 21. The elastic element 203 is arranged between the corresponding keycap 201 and the switch circuit board 22, and aligned with the corresponding key switch 224. When the elastic element 203 is pushed by the keycap 201, the corresponding key switch 224 is triggered by the elastic element 203. In an embodiment, the elastic element 203 is a rubbery elastomer, and the scissors-type connecting element 202 is made of a plastic material.

Please refer to FIGS. 7 and 8 again. Both of the first stabilizer bar 204 and the second stabilizer bar 205 are connected with the keycap 201. The first stabilizer bar 204 comprises a first linking bar part 2041 and two first hook parts 2042. The first linking bar part 2041 is connected with the keycap 201. The two first hook parts 2042 are located at two ends of the first stabilizer bar 204, respectively. Similarly, the second stabilizer bar 205 comprises a second linking bar part 2051 and two second hook parts 2052. The second linking bar part 2051 is connected with the keycap 201. The two second hook parts 2052 are located at two ends of the second stabilizer bar 205, respectively.

The base plate 21 comprises plural base plate hooks 211 and plural connecting structures 212. The plural base plate hooks 211 and the plural connecting structures 212 are protruded upwardly from the base plate 21. Moreover, the plural base plate hooks 211 are connected with the scissors-type connecting element 202 in order to fix the scissors-type connecting element 202 on the base plate 21. The plural connecting structures 212 correspond to the first stabilizer bar 204 and the second stabilizer bar 205. When the first hook parts 2042 and the second hook parts 2052 are connected with the connecting structures 212, the first stabilizer bar 204 and the second stabilizer bar 205 are fixed on the base plate 21.

Moreover, the keycap 201 comprises plural first coupling parts 2011 and plural second coupling parts 2012. The plural first coupling parts 2011 are disposed on an inner surface of the keycap 201 and connected with the scissors-type connecting element 202. The plural second coupling parts 2012 are also disposed on the inner surface of the keycap 201. The plural second coupling parts 2012 are connected with the first linking bar part 2041 and the second linking bar part 2051.

The first buffering sheath 23 is used for covering the first stabilizer bar 204. The first buffering sheath 23 and the first stabilizer bar 204 are collaboratively connected with the connecting structure 212. The first stabilizer bar 204 and the connecting structure 212 are separated from each other through the first buffering sheath 23. Consequently, the collision between the first stabilizer bar 204 and the connecting structure 212 is alleviated. The first buffering sheath 23 comprises a first buffering part 231 and two second buffering parts 232. The first buffering part 231 is arranged around the first linking bar part 2041 to cover the first linking bar part 2041. The second buffering parts 232 are connected with the first buffering part 231. The second buffering parts 232 are arranged around the first hook parts 2042 to cover the first hook parts 2042. The first buffering part 231 and the first linking bar part 2041 are collaboratively connected with the corresponding second coupling parts 2012. The second buffering parts 232 and the first hook parts 2042 are collaboratively connected with the corresponding connecting structures 212.

Like the first buffering sheath 23, the second buffering sheath 24 is used for covering the second stabilizer bar 205. The second buffering sheath 24 and the second stabilizer bar 205 are collaboratively connected with the connecting structure 212. The second stabilizer bar 205 and the connecting structure 212 are separated from each other through the second buffering sheath 24. Consequently, the collision between the second stabilizer bar 205 and the connecting structure 212 is alleviated. The second buffering sheath 24 comprises a third buffering part 241 and two fourth buffering parts 242. The third buffering part 241 is arranged around the second linking bar part 2051 to cover the second linking bar part 2051. The fourth buffering parts 242 are connected with the third buffering part 241. The fourth buffering parts 242 are arranged around the second hook parts 2052 to cover the second hook parts 2052. The third buffering part 241 and the second linking bar part 2051 are collaboratively connected with the corresponding second coupling parts 2012. The fourth buffering parts 242 and the second hook parts 2052 are collaboratively connected with the corresponding connecting structures 212.

In an embodiment, the first buffering part 231 and the two second buffering parts 232 are integrally formed, and the third buffering part 241 and the two fourth buffering parts 242 are integrally formed. Moreover, the first buffering sheath 23 and the second buffering sheath 24 are made of silicon rubber or any other appropriate soft material.

As mentioned above, the first stabilizer bar 204 is covered by the first buffering sheath 23, and the second stabilizer bar 205 is covered by the second buffering sheath 24. Consequently, the first buffering part 231 covering the first linking bar part 2041 and the third buffering part 241 covering the second linking bar part 2051 are rotatable relative to the corresponding second coupling parts 2012. Similarly, the second buffering parts 232 covering the first hook parts 2042 and the fourth buffering parts 242 covering the second hook parts 2052 are rotatable relative to the corresponding connecting structures 212. The first buffering part 231 is arranged between the first linking bar part 2041 and the corresponding second coupling parts 2012. The third buffering part 241 is arranged between the second linking bar part 2051 and the corresponding second coupling parts 2012. Since the first linking bar part 2041 and the corresponding second coupling parts 2012 are separated from each other through the first buffering part 231, the collision between the first linking bar part 2041 and the corresponding second coupling parts 2012 is alleviated. Since the second linking bar part 2051 and the corresponding second coupling parts 2012 are separated from each other through the third buffering part 241, the collision between the second linking bar part 2051 and the corresponding second coupling parts 2012 is alleviated.

The exploded view of the switch circuit board 22 is shown in FIG. 9. The upper wiring plate 221 comprises an upper circuit pattern 2211. In addition, the upper circuit pattern 2211 is formed on a bottom surface of the upper wiring plate 221. The lower wiring plate 222 is located under the upper wiring plate 221. The lower wiring plate 222 comprises a lower circuit pattern 2221. In addition, the lower circuit pattern 2221 is formed on a top surface of the lower wiring plate 222. The separation layer 223 is arranged between the upper wiring plate 221 and the lower wiring plate 222. In addition, the separation layer 223 comprises plural perforations 2231 corresponding to plural keycaps 201. The upper circuit pattern 2211 and the lower circuit pattern 2221 are separated from each other through the separation layer 223. Moreover, plural key switches 224 are defined by the upper circuit pattern 2211, the plural perforations 2231 and the lower circuit pattern 2221 collaboratively. Each key switch 224 is aligned with the corresponding key structure 20 or 20'. When the key switch 224 is triggered by the corresponding key structure 20 or 20', the corresponding key signal is generated.

Figure 10:
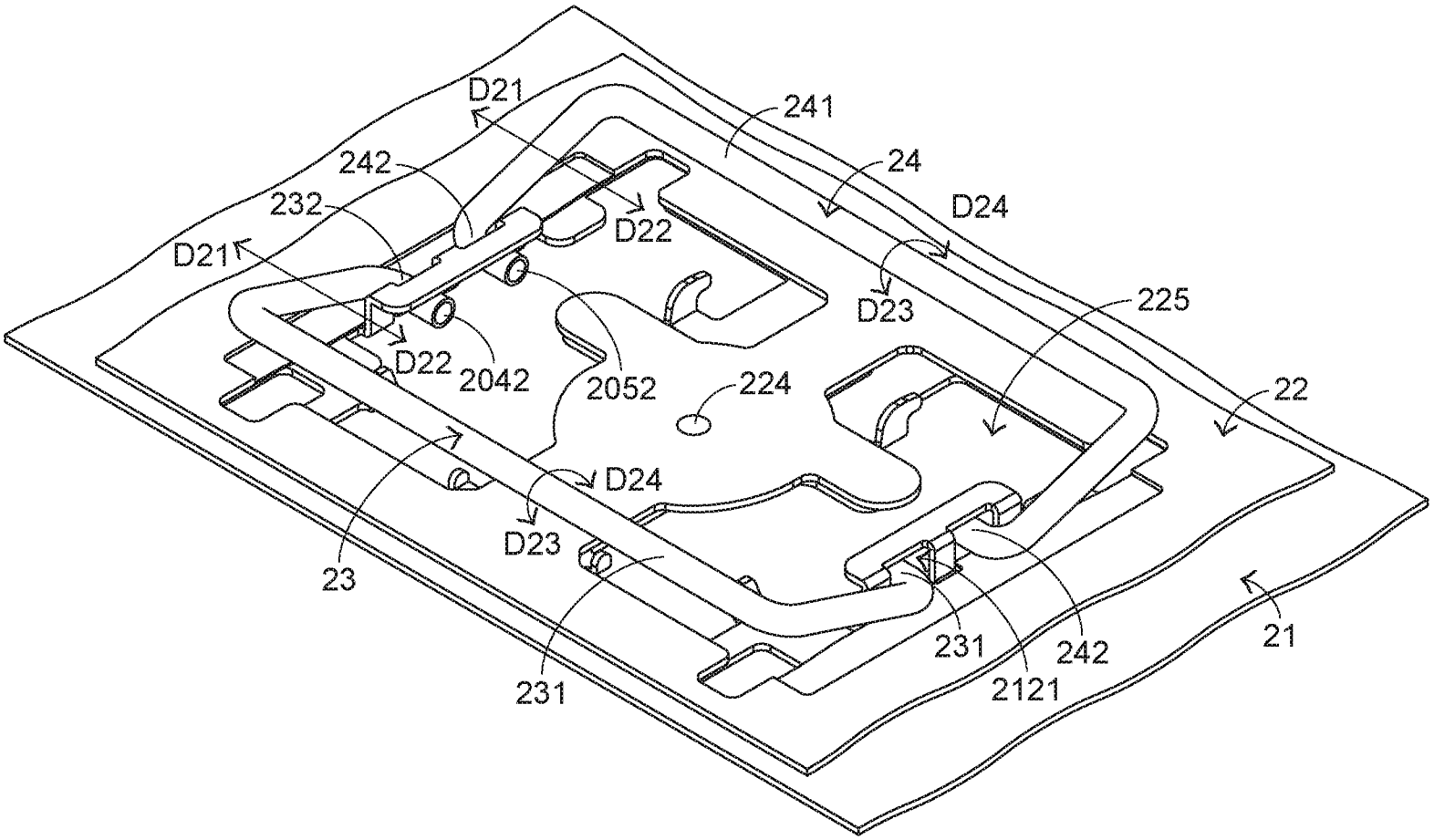
FIG. 10 schematically illustrates the actions of the first stabilizer bar and the second stabilizer bar of the keyboard device according to the embodiment of the present invention.

FIG. 10 schematically illustrates the actions of the first stabilizer bar and the second stabilizer bar of the keyboard device according to the embodiment of the present invention. Please refer to FIGS. 7 and 10. The plural connecting structures 212 are disposed on the base plate 21 and penetrated through the corresponding openings 225 of the switch circuit board 22. Each connecting structure 212 comprises plural locking holes 2121 corresponding to the first hook parts 2042 (and the second buffering parts 232) and the second hook parts 2052 (and the fourth buffering parts 242). The second buffering parts 232 covering the first hook parts 2042 and the fourth buffering parts 242 covering the second hook parts 2052 are inserted into the corresponding locking holes 2121. Consequently, the first stabilizer bar 204 and the second stabilizer bar 205 are connected with the base plate 21, and the first hook parts 2042 (and the second buffering parts 232) and the second hook parts 2052 (and the fourth buffering parts 242) are permitted to be rotated within the locking holes 2121. In accordance with the feature of the present invention, the keyboard device 2 comprises the first buffering sheath 23 and the second buffering sheath 24. The second buffering parts 232 are arranged between the first hook parts 2042 and the corresponding connecting structures 212, and the fourth buffering parts 242 are arranged between the second hook parts 2052 and the corresponding connecting structures 212. That is, the first hook parts 2042 and the corresponding connecting structures 212 are separated from each other through the second buffering parts 232, and the second hook parts 2052 and the corresponding connecting structures 212 are separated from each other through the fourth buffering parts 242. Since the collision between the first hook parts 2042 and the corresponding connecting structures 212 and the collision between the second hook parts 2052 and the corresponding connecting structures 212 are alleviated, the unpleasant noise is not generated.

The operations of depressing the key structure 20' will be described as follows. While the keycap 201 of any key structure 20' is depressed, the keycap 201 is moved downwardly relative to the base plate 21. Since the scissors-type connecting element 202 is pushed by the keycap 201, the scissors-type connecting element 202 is correspondingly swung. Moreover, as the keycap 201 is moved downwardly to push the elastic element 203, the elastic element 203 is subjected to deformation to trigger the corresponding key switch 224. Consequently, the corresponding key signal is generated. When the key structure 20' is no longer depressed, the keycap 201 is moved upwardly relative to the base plate 21 in response to a restoring elastic force of the elastic element 203. As the keycap 201 is moved upwardly, the scissors-type connecting element 202 is correspondingly swung and switched from the stacked state to the open-scissors state again. Consequently, the keycap 201 is returned to its original position.

Please refer to FIG. 10 again. While the keycap 201 of the key structure 20' is moved upwardly or downwardly relative to the base plate 21, the first buffering sheath 23 and the first stabilizer bar 204 in the first buffering sheath 23 are moved in a first direction D21 or a second direction D22 and rotated in a first rotating direction D23 or a second rotating direction D24. Moreover, the first linking bar part 2041 of the first stabilizer bar 204 and the first buffering sheath 23 are rotated relative to the corresponding second coupling parts 2012, and the two first hook parts 2042 and the two second buffering parts 232 are rotated within the corresponding locking holes 2121. Due to the second buffering parts 232, the first hook parts 2042 are not contacted with the base plate 21 during rotation. Similarly, the second buffering sheath 24 and the second stabilizer bar 205 in the second buffering sheath 24 are moved in the first direction D21 or the second direction D22 and rotated in the first rotating direction D23 or the second rotating direction D24. Moreover, the second linking bar part 2051 of the second stabilizer bar 205 and the third buffering part 241 are rotated relative to the corresponding second coupling parts 2012, and the two second hook parts 2052 and the two fourth buffering parts 242 are rotated within the corresponding locking holes 2121. Due to the fourth buffering parts 242, the second hook parts 2052 are not contacted with the base plate 21 during rotation.

From the above descriptions, the present invention provides the keyboard device. The buffering sheath is arranged around the stabilizer bar. Consequently, the stabilizer bar is covered by the buffering sheath and not exposed to the outside. The hook part is separated from the connecting structure of the base plate by the buffering sheath. The buffering sheath is made of the soft material. The stabilizer bar made of the metallic material is partially covered by the buffering sheath. Even if the hook parts are made of the metallic material, the hook parts are only contacted with the buffering sheath but not contacted with the metallic connecting structure. That is, the metallic components do not collide with each other to generate the unpleasant noise. Consequently, the keyboard device of the present invention is capable of reducing the noise.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard device, comprising:

a key structure comprising a keycap and a stabilizer bar, wherein the keycap is exposed outside the keyboard device, and the stabilizer bar is connected with the keycap;

a switch circuit board located under the key structure, and comprising a key switch corresponding to the key structure, wherein when the key switch of the switch circuit board is triggered by the key structure, a key signal is generated;

a base plate located under the switch circuit board, and supporting the key structure, wherein the base plate comprises a connecting structure, and the connecting structure is connected with the stabilizer bar; and a buffering sheath covering the stabilizer bar, wherein the buffering sheath and the stabilizer bar are collaboratively connected with the connecting structure, and the stabilizer bar and the connecting structure are separated from each other through the buffering sheath.

2. The keyboard device according to claim 1, wherein the stabilizer bar comprises a linking bar part and a hook part, wherein the linking bar part is connected with the keycap, and the hook part is located at an end of the linking bar part.

3. The keyboard device according to claim 2, wherein the buffering sheath comprises:

a first buffering part arranged around the linking bar part to cover the linking bar part; and a second buffering part connected with the first buffering part, and arranged around the hook part to cover the hook part, wherein the first buffering part and the linking bar part are collaboratively connected with the keycap, and the second buffering part and the hook part are collaboratively connected with the connecting structure.

4. The keyboard device according to claim 3, wherein the connecting structure comprises a locking hole corresponding to the hook part and the second buffering part, and the hook part and the second buffering part are collaboratively penetrated through the locking hole, so that the stabilizer bar is connected with the base plate, wherein the second buffering part is arranged between the connecting structure and the hook part, so that the connecting structure and the hook part are separated from each other through the second buffering part.

5. The keyboard device according to claim 3, wherein the keycap comprises a coupling part corresponding to the linking bar part and the first buffering part, and the linking bar part and the first buffering part are connected with the coupling part, so that the stabilizer bar is connected with the keycap, wherein the first buffering part is arranged between the coupling part and the linking bar part, and the linking bar part and the coupling part are separated from each other through the first buffering part.

6. The keyboard device according to claim 1, wherein the buffering sheath is made of silicone rubber.

7. The keyboard device according to claim 1, wherein the switch circuit board comprises:

an upper wiring plate comprising an upper circuit pattern, wherein the upper circuit pattern is formed on a bottom surface of the upper wiring plate;

a lower wiring plate located under the upper wiring plate, and comprising a lower circuit pattern, wherein the lower circuit pattern is formed on a top surface of the lower wiring plate; and a separation layer arranged between the upper wiring plate and the lower wiring plate, and comprising a perforation, wherein the upper circuit pattern and the lower circuit pattern are separated from each other through the separation layer, and the key switch is defined by the upper circuit pattern, the perforation and the lower circuit pattern collaboratively.

8. The keyboard device according to claim 7, wherein the switch circuit board has an opening corresponding to the connecting structure, and the opening runs through the upper wiring plate, the lower wiring plate and the separation layer, wherein the connecting structure is penetrated through the opening, so that the stabilizer bar is connected with the connecting structure.

9. The keyboard device according to claim 1, wherein the key structure further comprises:

a scissors-type connecting element connected with the keycap and the base plate, wherein the keycap is fixed on the base plate through the scissors-type connecting element, so that the keycap is movable relative to the base plate; and an elastic element arranged between the keycap and the switch circuit board and aligned with the key switch, wherein when the elastic element is pushed by the keycap, the switch circuit board is triggered by the elastic element, wherein when the elastic element is not pushed by the keycap, the elastic element provides an elastic force to the keycap.

10. The keyboard device according to claim 9, wherein the keycap further comprises an additional coupling part, wherein the additional coupling part is protruded from an inner surface of the keycap and connected with the scissors-type connecting element.

* * * * *